US005201077A

United States Patent [19]

Dondlinger

[11] Patent Number: 5,201,077

[45] Date of Patent: Apr. 13, 1993

[54] CAP WITH DETACHABLE SUN SHIELD

[76] Inventor: Steven C. Dondlinger, 5513 Knoll Dr., Edina, Minn. 55436

[21] Appl. No.: 876,092

[22] Filed: Apr. 30, 1992

[51] Int. Cl.[5] ..... A42B 1/06

[52] U.S. Cl. ..... 2/199; 2/196; 2/DIG. 6

[58] Field of Search ..... 2/171, 172, 185 R, 196, 2/209.1, DIG. 6

[56] References Cited

U.S. PATENT DOCUMENTS 4,980,928 1/1991 Ellis ..... 2/199
5,035,004 7/1991 Koester ..... 2/199
5,046,195 9/1991 Koritan ..... 2/199
5,081,717 1/1992 Shedd ..... 2/199
5,121,507 6/1992 Brown ..... 2/199

*Primary Examiner*—Andrew M. Falik
*Assistant Examiner*—Diana L. Biefeld
*Attorney, Agent, or Firm*—Hugh D. Jaeger

[57] ABSTRACT

Cap with detachable sun shield, which shields the wearer's neck and/or face, where a sun shield readily attaches to and detaches from the outer circumferential surface of a cap band by the use of suitably attached VELCRO loop and hook strips.

20 Claims, 6 Drawing Sheets

CAP WITH DETACHABLE SUN SHIELD

BACKGROUND OF THE INVENTION

1. Field of the Invention

The present invention pertains to protective clothing, and more particularly, pertains to a cap with a detachable and self-storable sun shield.

2. Description of the Prior Art

The prior art devices pertaining to protective clothing failed to produce a cap and shield for ultraviolet protection of the epidermis which readily and handily attached to a cap without a deal of difficulty. Prior art devices have also not disclosed a shield attaching to the outer circumferential surface of the cap band.

The prior art caps have not provided for a totally storing sun shield.

The present invention provides a cap and shield for epidermal protection from ultraviolet exposure, where the shield readily attaches and self stores in the top of the cap.

SUMMARY OF THE INVENTION

The general purpose of the present invention includes a cap with a detachable and storable sun shield. According to one embodiment of the present invention, there is provided a cap including a hat band at the lower inner circumferential surface. VELCRO fastener strips are attached to opposing outer circumferential surfaces of the hat band to accommodate upper edges of a sun shield. The upper edges of the sun shield include VELCRO fastener strips correspondingly attach for subsequent engagement with the VELCRO fastener strips of the outer circumferential surfaces of the hat band.

One significant aspect and feature of the present invention is a cap with a detachable sun shield for ultraviolet epidermal protection.

Another significant aspect and feature of the present invention is opposing VELCRO fastener strips suitably secured to the outer portion of a hat band.

A further significant aspect and feature of the present invention is opposing VELCRO fastener strips suitably secured to the upper edge of a detachable sun shield.

Yet another significant aspect and feature of the present invention is the engagement of VELCRO fastener strips to attach a sun shield to a cap via the outer circumferential surface of a hat hand, which provides for comfort to the wearer of the hat.

Having thus described one embodiment of the present invention, it is the principal object hereof to provide a protective cap and shield which attaches to the outer circumferential surface of the hat band.

BRIEF DESCRIPTION OF THE DRAWINGS

Other objects of the present invention and many of the attendant advantages of the present invention will be readily appreciated as the same becomes better understood by reference to the following detailed description when considered in connection with the accompanying drawings, in which like reference numerals designate like parts throughout the figures thereof and wherein.

DETAILED DESCRIPTION OF THE PREFERRED EMBODIMENTS

Figure 1:
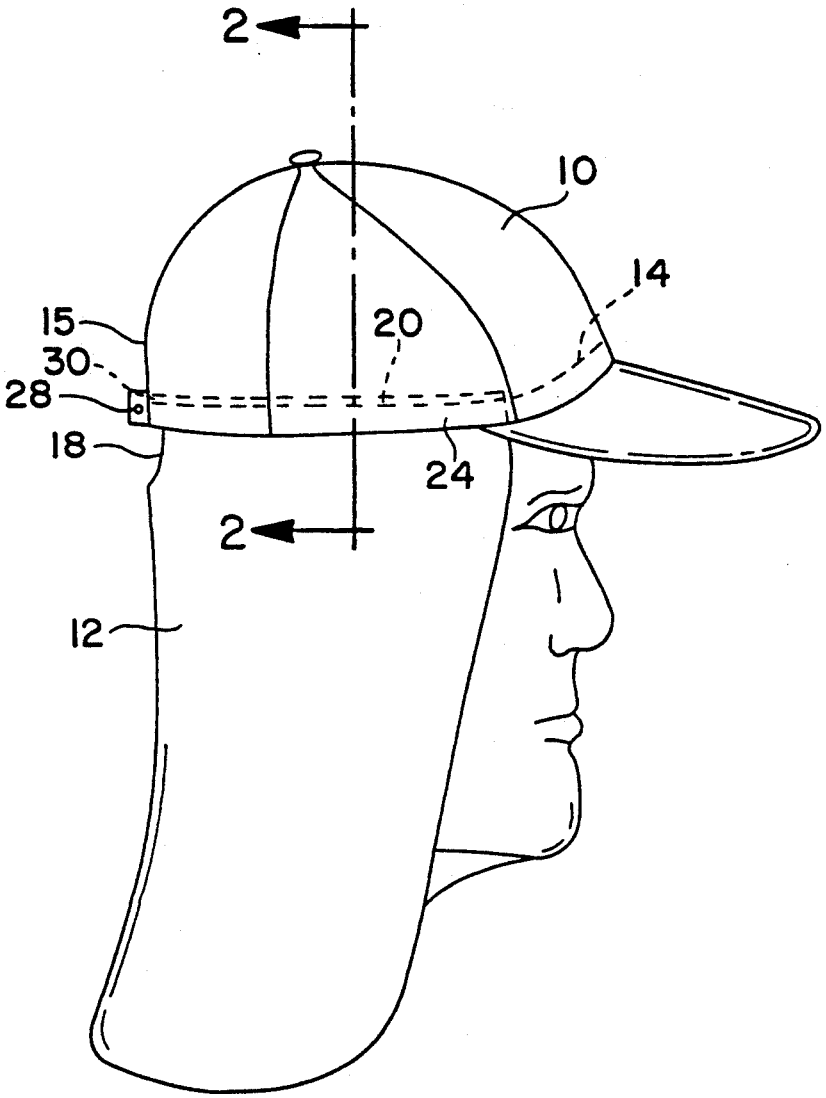
FIG. 1 illustrates a side view of a cap with a detachable sun shield.

FIG. 1 illustrates a cap 10 with a detachable sun shield 12 attached to and extending downwardly from the sides and rear of the cap 10 as illustrated to protect the wearer's neck and face from harmful and unneeded ultraviolet radiation. The cap 10 includes a cap band 14 extending about the inner, lower periphery of the cap 10. A cap cutout 15 is located at the rearward lower edge of the cap 10 and includes adjustable bands 28 and 30. The sun shield 12 is comprised mainly of cloth or other suitable fabric, which protects from ultraviolet rays, and is attached to the outer surface of the hat band 14 by VELCRO strips as later described in detail. In an alternative embodiment, the sun shield can be of a disposable material, such as paper, and include attachment structure, such as adhesive tape or the like.

Figure 2:
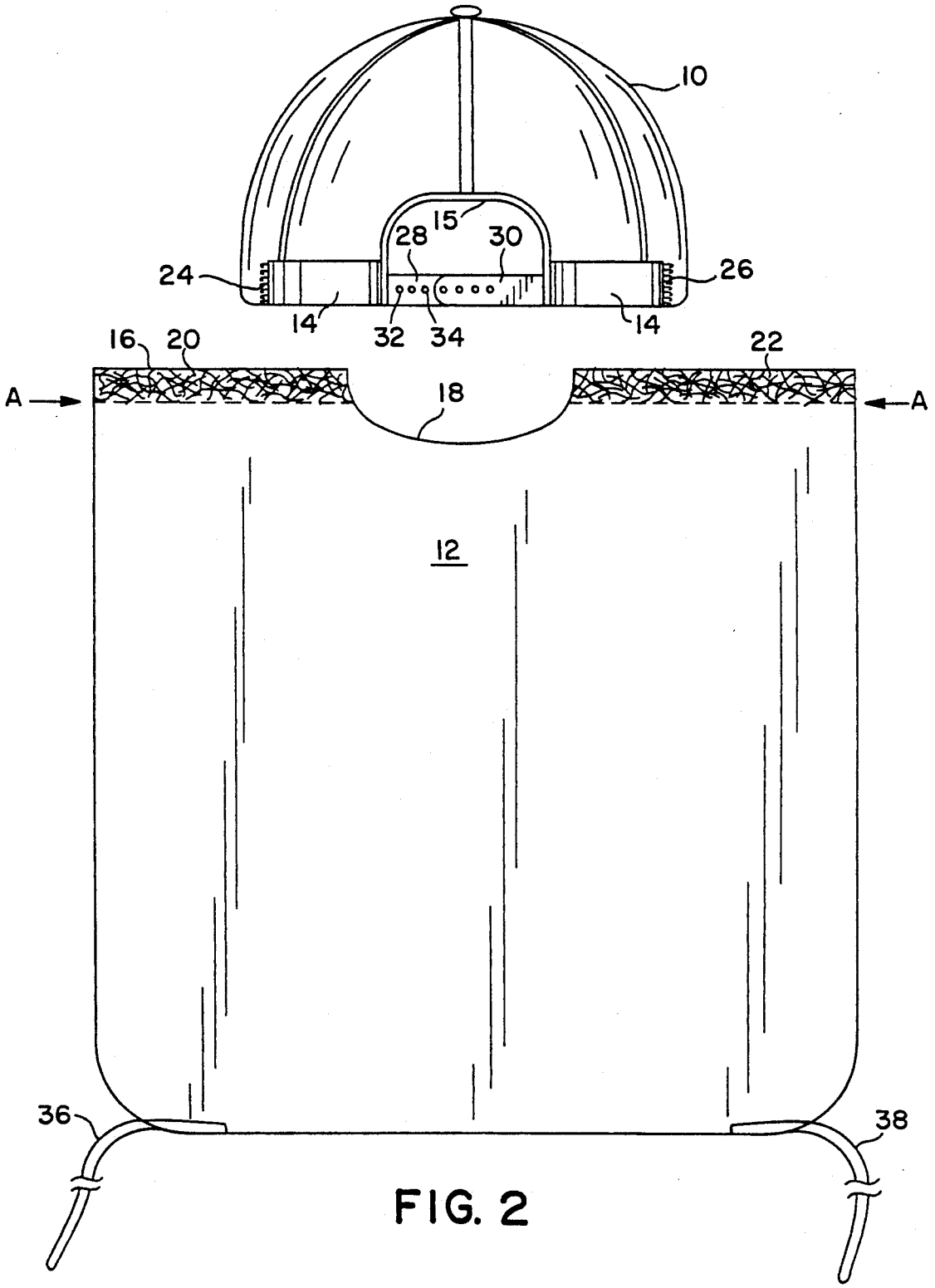
FIG. 2 illustrates a cross-sectional view of the hat along line 2—2 of FIG. 1.
Figure 4:
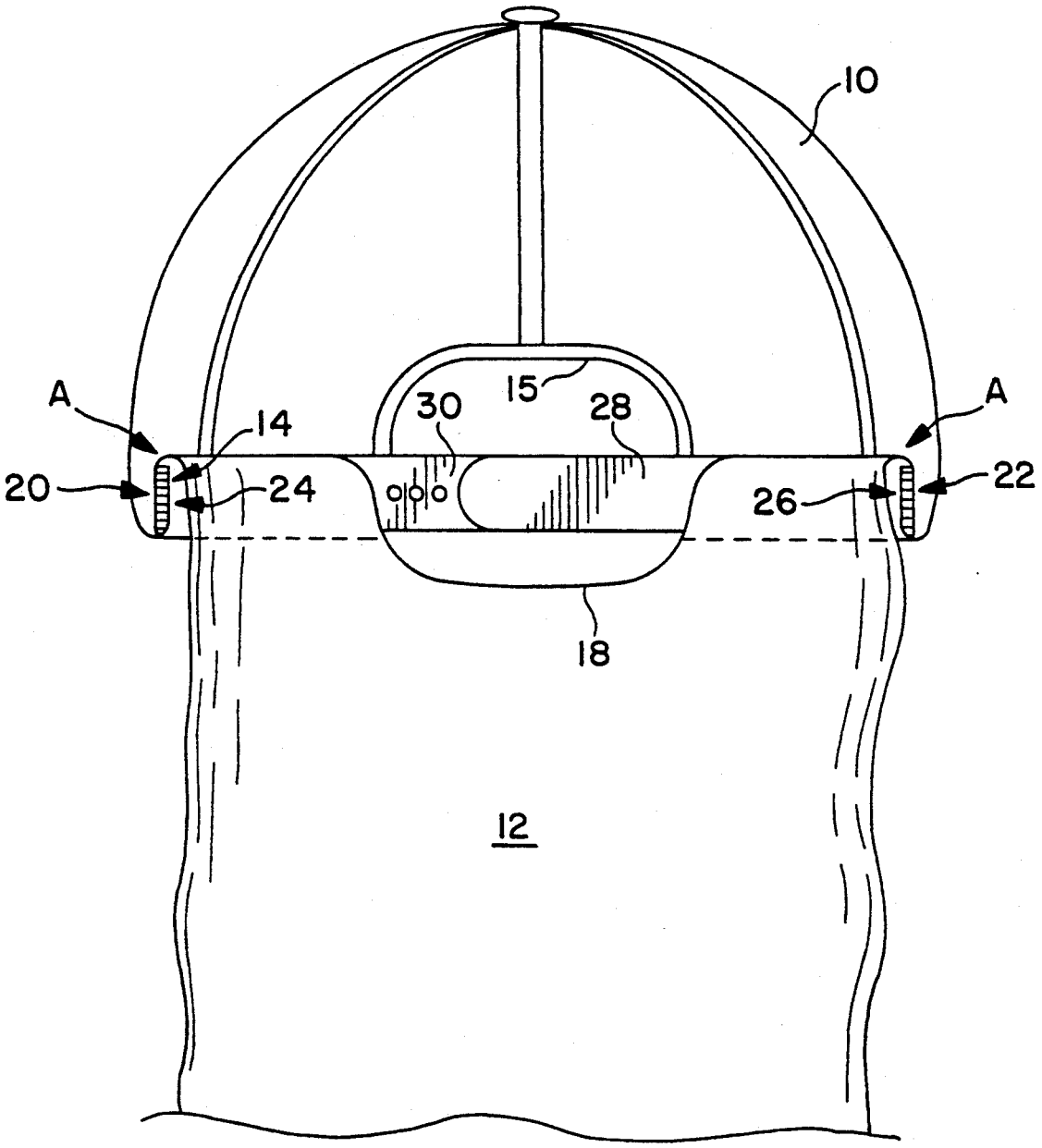
FIG. 4 illustrates the elements of FIG. 2 in mutual engagement.

FIG. 2 illustrates a cross-sectional view of the hat 10 along lines 2—2 of FIG. 1, and a front view of the sun shield 12 where all numerals correspond to those elements previously described. The sun shield 12 is essentially rectangular in shape. The top edge 16 of the sun shield 12 is interrupted by a shield cutout 18 and includes VELCRO loop strips 20 and 22 secured by suitable means to the back, upper surface. The VELCRO loop strips 20 and 22 fold over and about the axis indicated by arrows A, and engage VELCRO hook strips 24 and 26 attached by appropriate means to the outside surface of the cap band 14 as illustrated in FIG. 4. The area of the cap band 14 at the lower, inner periphery of the cap 10 is exaggerated slightly for the purpose of clarity in the illustration, wherein the actual distance is somewhat less than illustrated. Adjustable bands 28 and 30, including a plurality of snaps and holes 32 and 34, also secure and align in the cap band 14 to allow the cap 10 to be fitted to an individual's appropriate cap size. Two optional ties 36 and 38 are at the lower end of the sun shield 12 for tying off the sun shield.

Figure 3:
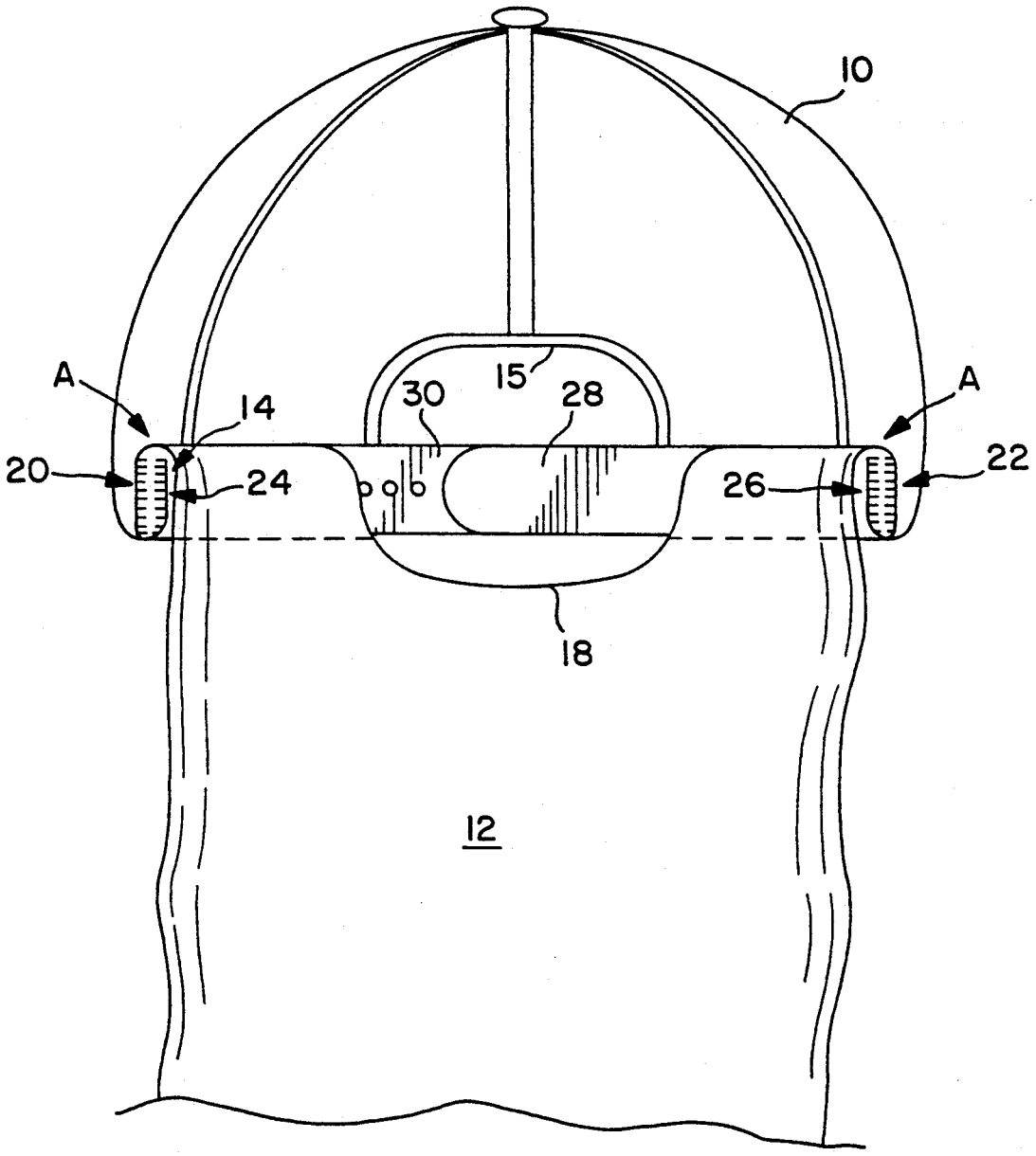
FIG. 3 illustrates the elements of FIG. 2 prior to mutual engagement.

FIG. 3 illustrates the elements as viewed in FIG. 2, namely the cap 10 and sun shield 12 prior to mutual engagement where all numerals correspond to those elements previously described. The upper edge of the sun shield 12 is folded about and along axis A, as previously described, to align the VELCRO loop strips 20 and 22 of the sun shield 12 with the VELCRO hook strips 24 and 26 of the cap band 14, respectively.

Mode of Operation

FIG. 4 illustrates the elements as viewed in FIG. 2, namely the cap 10 and the sun shield 12 in mutual engagement where all numerals correspond to those elements previously described. Subsequent to VELCRO alignment as illustrated in FIG. 3, the VELCRO loop strip 20 of the sun shield 12 engages the VELCRO hook strip 24 of the hat band 14, and the VELCRO loop strip 22 of the sun shield 12 engages the VELCRO hook strip 26 of the hat band 14, thus securing the sun shield 12 to the outer circumference of the cap band 14 of the cap 10. The particular placement of the hooks on the inside of the hat band provides for a smooth hat band, in addition to the wrap around effect of the sun shield around the hat band.

The VELCRO loop strips and VELCRO hook strips could also be broken up or segmented, or in the alternative, could be round portions of VELCRO material, such as VELCRO dots. The VELCRO strips are not to be construed as limiting of the present invention, and are by way of example and for purposes of illustration only. VELCRO circles or VELCRO dots positioned along the hat band and along the sun shield would also serve the same function, the same purpose, and accomplish the end desired result.

The sun shield has numerous uses, and can be used as a handkerchief, can be wetted, such as with water, and then the sun shield acts a cooling device. The sun shield also absorbs perspiration.

While the primary purpose of the sun shield is to prevent skin cancer, the sun shield can also be used as an advertising medium and include printed information, such as sport's logos or spirits (alcohol) logos. The sun shield can also carry any type of printed information or printed messages.

Figure 5:
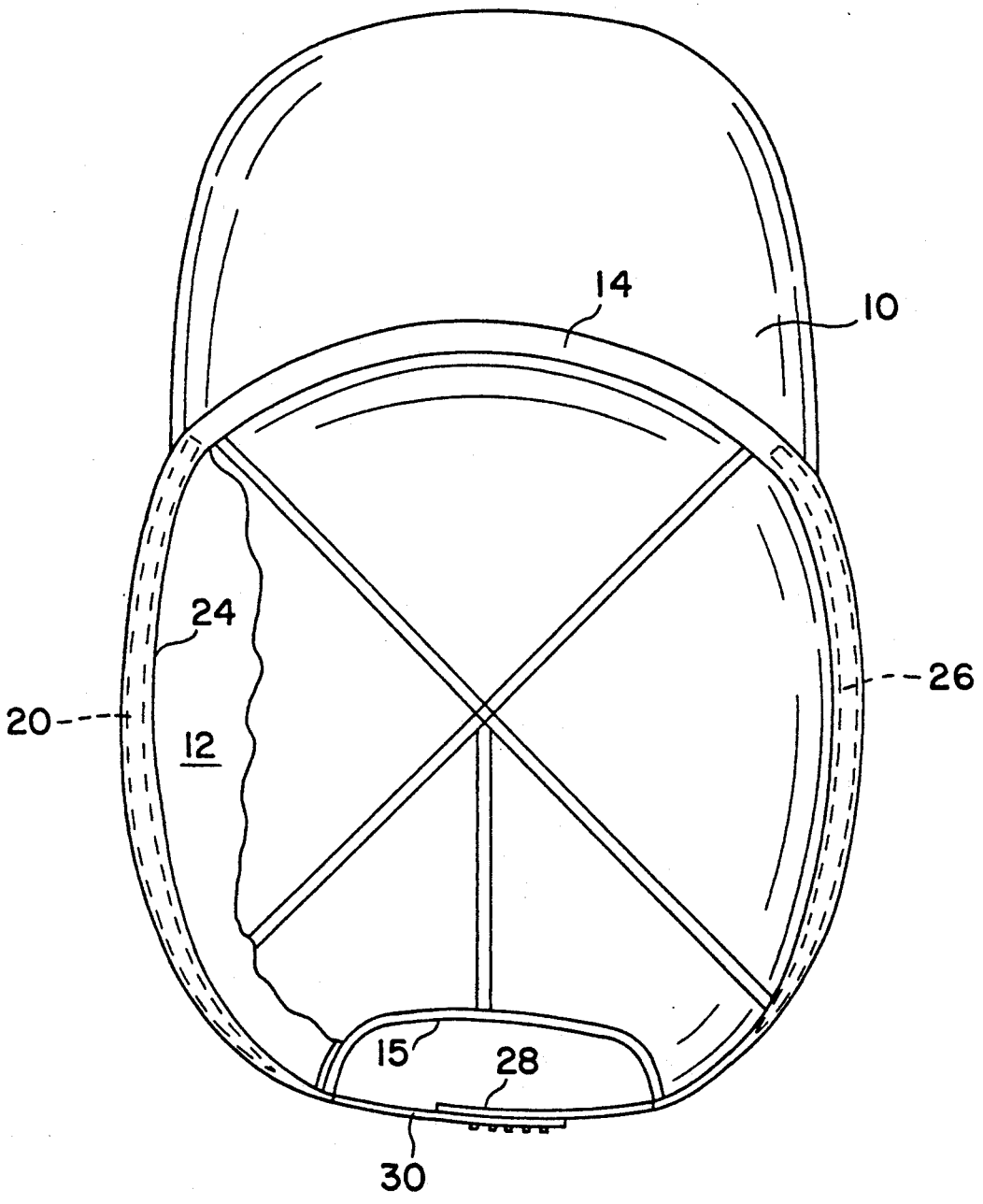
FIG. 5 illustrates a bottom view of the cap and a portion of the sun shield; and, FIG. 6 illustrates the sun shield stored in the cap dome.

FIG. 5 illustrates a bottom view of the cap 10 and a portion of the sun shield 12 where all numerals correspond to those elements previously described. Illustrated in particular is the alignment of the VELCRO strips to the hat band 14. VELCRO hook strips 24 and 26, illustrated in dashed lines, are suitably secured to the inside of the hat band 14. A portion of the sun shield 12 is illustrated attached to the cap band 14 by engagement of VELCRO loop strip 20 and VELCRO hook strip 24.

Figure 6:
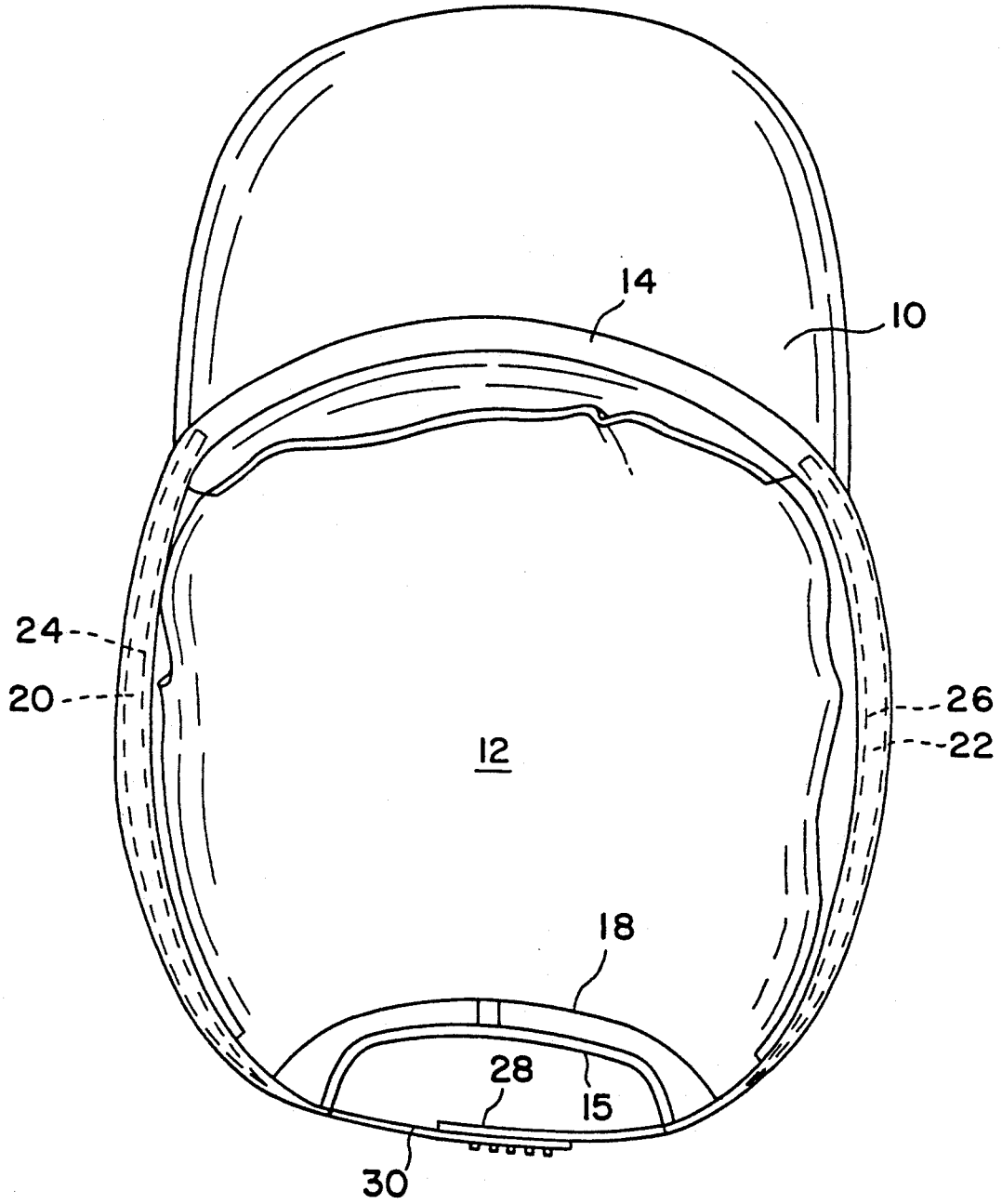

FIG. 6 illustrates bottom view of the cap 10 and sun shield 12 stored in the upper region of the cap dome. The cap 10 may also be utilized without the sun shield 12 deployed from the lower edge of the cap 10. The sun shield 12 may be stored in the dome portion of the hat 10 by simply folding it over appropriately, and then pressing the folded sun shield 12 into the upper dome portion of the cap 10 as shown. The folded sun shield 12 is supported on two sides by the VELCRO loop and hook strip combinations 20 and 24 and 22 and 26, thus causing the sun shield to remain in storage even while the hat is worn, and eliminating the need for a storage area external to the cap 10.

The shield cutout area 18 is larger in size than the cup cutout 15. The sun shield 12 stores upwardly and inwardly along the upper cap dome area and well disposed from the cap cutout 15 so that the shield 12 and the shield cutout 18 are visually well hidden from an observation point posterior to the cap wearer. This feature also holds true when, as in popular style, the cap is worn in a reverse orientation on the wearer's head.

One size of the sun shield is about 14" long by 16" wide by way of example and for purposes of illustration only and not to be construed as limiting of the present invention.

Various modifications can be made to the present invention without departing from the apparent scope hereof.

I claim:

1. A cap with a detachable sun shield comprising:

a. the cap including a cap band having a hook strip material attached to an outer surface of said cap band;

b. a sun shield having two strips of loop material secured at opposing sides of a top edge of the sun shield, a cutout centrally located at said top edge between said two strips of loop material; and, c. said top edge with the two strips of loop material secured at opposing sides thereof having a fold line along a horizontal axis, whereby said two strips of loop material may be presented for hook and loop strip material engagement with said hook strip material of said cap band, and whereby said top edge having said two strips of loop material secured at opposing sides thereof may engage said hook strip material in said cap band to attach said sun shield to said cap.

2. The sun shield of claim 1 wherein said shield is used to prevent skin cancer.

3. The sun shield of claim 1 including advertising printed on said sun shield.

4. The sun shield of claim 3 wherein said advertising is for sports logos.

5. The sun shield of claim 3 wherein said advertising is for spirits logos.

6. The sun shield of claim 1 wherein said shield is used for a handkerchief.

7. The sun shield of claim 1 wherein said shield absorbs perspiration.

8. The sun shield of claim 1 wherein said sun shield is a cooling means when wet.

9. The sun shield of claim 1 including a tie at each end.

10. A cap with a detachable sun shield comprising:

a. the cap including a cap band having opposing hook strip material means attached to outer surfaces of said cap band;

b. a sun shield having two strips of loop material means secured at opposing sides of a top edge of the sun shield, a cutout centrally located at said top edge between said two strips of loop material; and, c. said top edge with the two strips of loop material secured at opposing sides thereof having a fold line along a horizontal axis, whereby said two strips of loop material may be presented for hook and loop strip material engagement with said hook strip material of said cap band, and whereby said top edge having said two strips of loop material secured at opposing sides thereof may engage said hook strip material in said cap band to attach said sun shield to said cap.

11. The sun shield of claim 10 wherein said shield is used to prevent skin cancer.

12. The sun shield of claim 11 including advertising printed on said sun shield.

13. The sun shield of claim 12 wherein said advertising is for sports logos.

14. The sun shield of claim 12 wherein said advertising is for spirits logos.

15. The sun shield of claim 10 wherein said shield is used for a handkerchief.

16. The sun shield of claim 10 wherein said shield absorbs perspiration.

17. The sun shield of claim 10 wherein said sun shield is a cooling means when wet.

18. The sun shield of claim 10 including a tie at each end.

19. In combination with a cap a detachable sun shield comprising:

a. the detachable sun shield being of a size and a material to be capable of being stored in an upper dome region of the cap, said sun shield including a cutout area along an upper edge thereof, said sun shield cutout area disposed inwardly and upwardly from a rear cap cutout when the sun shield is being stored in the upper dome region of the cap; and, b. said sun shield cutout being larger than said cap cutout in order to be hidden from view through the cap cutout when the sun shield is being stored in the dome of the cap, said sun shield being supported by one or more regions of hook and loop strip material engagement means of said sun shield and a cap band of said cap, whereby when the sun shield is being stored in the dome of the cap the cap and stored sun shield may be worn in a normal fashion or with said cap containing the stored sun shield worn backwards.

20. In combination, a cap and a detachable sun shield comprising:

a. the cap including a cap band having a hook strip material attached to an outer surface of said cap band; and, b. a sun shield having two strips of loop material secured at opposing sides of a top edge of the sun shield, a cutout centrally located at said top edge between said two strips of loop material, said top edge with the two strips of loop material secured at opposing sides thereof having a fold line along a horizontal axis, whereby said two strips of loop may be presented for hook and loop strip material engagement with said hook strip material of said cap band, and whereby said top edge with the two strips of loop material secured at opposing sides thereof may engage said hook strip material in said cap band to attach said sun shield to said cap.

* * * * *